US005388485A

United States Patent [19]

Auble

[11] Patent Number: 5,388,485

[45] Date of Patent: Feb. 14, 1995

[54] OIL FILTER WRENCH

[76] Inventor: Larry L. Auble, 135 Park Pl., Apt. #5, Wellington, Ohio 44090

[21] Appl. No.: 82,387

[22] Filed: Jun. 28, 1993

[51] Int. Cl.[6] ..... B25B 13/52

[52] U.S. Cl. ..... 81/64; 81/3.43

[58] Field of Search ..... 81/3.43, 64, 65, 900

[56] References Cited

U.S. PATENT DOCUMENTS 4,750,388 6/1988 Hagen et al. ..... 81/64
4,778,730 10/1988 Zucker ..... 81/900 X
4,916,943 4/1990 Siekawitch ..... 81/64

*Primary Examiner*—James G. Smith

[57] ABSTRACT

A new and improved oil filter wrench includes a band assembly. An abrasive-surface-containing flexible sheet assembly is connected to the band assembly and is installed over the inner band surface. A handle assembly is connected respective ends of the band assembly. The abrasive-surface-containing flexible sheet assembly includes a sandpaper strip. An adhesive layer is applied to a backside of the sandpaper strip. A flexible, sandpaper strip mounting unit receives the adhesive-backed sandpaper strip. The sandpaper strip mounting unit includes a plurality of projections for connecting the unit to the band assembly. The band assembly includes a plurality of mounting apertures, and the projections project rearward from the sandpaper strip mounting unit and engage the mounting apertures, such that the flexible, sandpaper strip mounting unit is mounted on the band assembly. The handle assembly includes a band tightening element pivotally connected to a hand grip portion. A handle member is connected to a portion of the band tightening element, such that a portion of the handle member can be rotated outside the plane of the band assembly to install or remove an oil filter. A torque indicating assembly is connected to the band assembly for indicating torque applied by the apparatus to the oil filter. A hand-protecting shroud assembly is installed on the handle assembly for protecting a user's hand during use of the apparatus.

5 Claims, 4 Drawing Sheets

FIG. 3
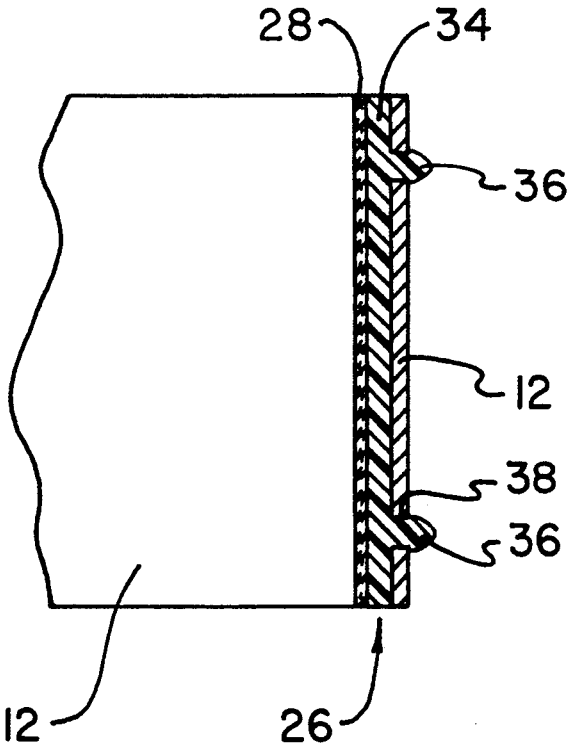
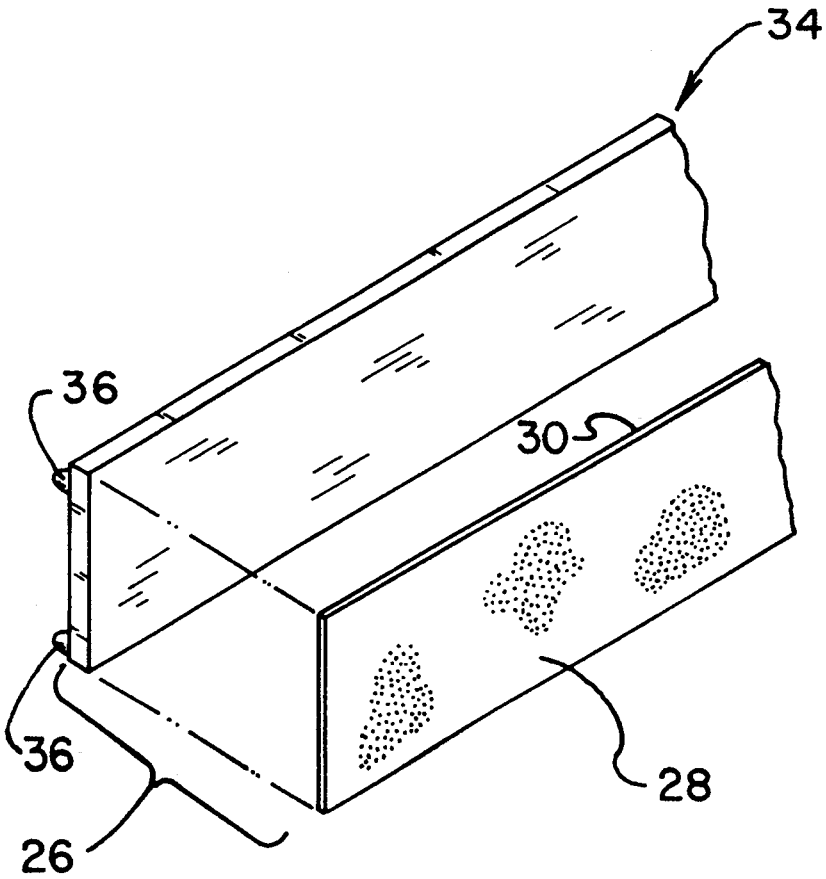
FIG. 4

OIL FILTER WRENCH

BACKGROUND OF THE INVENTION

1. Field of the Invention

The present invention relates generally to wrenches specially designed to aid in motor vehicle maintenance, and more particularly, to a wrench especially adapted for removal and replacement of oil filters.

2. Description of the Prior Art

A variety of oil filter wrenches are known in the prior art for aiding the removal and replacement of an oil filter from an engine. For example, the following U.S. patents are known: U.S. Pat Nos. 4,266,452; 4,506,568; 5,024,760; 5,065,648; and U.S. Pat. No. Des. 307,101.

More specifically, U.S. Pat. No. 4,266,452 discloses an oil filter wrench that includes a flexible rubber of plastic sleeve that fits over the oil filter. Gripping between the oil filter sleeve and the oil filter depends upon a wedging action between the sleeve and the oil filter. Such a device has an important drawback. The surfaces of oil filters are often very slippery due to oil leaks from the engine or oil spills on the filter during addition of oil to the crankcase during maintenance operations. In such a case, it may be very difficult to establish a good, non-slipping grip between the sleeve and the oil filter. In this respect, it would be desirable if an oil filter wrench device were provided that did not slip when oil was present on the surface of the oil filter.

U.S. Pat. No. 4,506,568 discloses an oil filter wrench that has a two-part holder structure which has one part nested with the other part. Rotation of the inside part of the holder will lock the ends of the strap to the holder and further rotation of the holder than causes the strap to rotate the oil filter held in the loop of the strap. A significant disadvantage is associated with this the use of this device. Two major parts of the device must be separated from each other during a critical phase in using the device. With separation, there runs the risk of one being dropped or lost at a critical time. Moreover, with two separate devices, one hand would have to be placed on one part, and the other hand would have to be placed on the other part. This can pose a problem when a worker needs the use of one hand to maintain balance. In this respect, it would be desirable if an oil filter wrench device were provided which did not require the user of the device to occupy two hands in manipulating the device.

U.S. Pat. No. 5,024,760 discloses an oil filter that includes unconventional bracket type fins. To use an oil filter wrench would be difficult. The fins would get in the way. In this respect, it would be desirable if an oil filter wrench device were provided that can be successfully used with conventional oil filters and need not be used with special oil filters having bracket fin structures.

U.S. Pat. No. 5,065,648 discloses an oil filter wrench which includes two semi-circular, semi-rigid sections each of which includes a plurality of shark tooth-shaped projections which engage an oil filter of an internal combustion engine. A serious problem associated with the use of this oil filter wrench is that it destroys the oil filter. More specifically, the shark tooth-shaped projections are capable of tearing into and cutting the housing for the oil filter. This means that this device can only be used for removing an oil filter. It cannot be used for installing an oil filter. In this respect, it would be desirable if an oil filter wrench device were provided that can be used for both removing and installing an oil filter. Another problem with this device is oil spillage. When an oil filter housing is punctured during removal of the oil filter from the engine, oil can leak out from the punctured casing and make an oily mess. In this respect, it would be desirable if an oil filter wrench device were provided that did not puncture the oil filter housing and tat did not make an oily mess during oil filter removal.

U.S. Pat. No. Des. 307,101 discloses an oil filter wrench that includes a sequential orderly array of discrete bumps attached to the inside surface of a loop which fits around an oil filter. The size of the bumps indicates that when this oil filter wrench would be applied to an oil filter, there is a serious risk that the oil filter would be undesirably weakened and deformed by the bumps. In this respect, it would be desirable if an oil filter wrench device were provided which did not deform or weaken the oil filter when the oil filter wrench is used.

Aside from the problems stated above, prior art oil filter wrenches have another problem. Generally, oil filter wrenches have to major parts: the filter grabbing part; and the handle. Both the filter grabbing part and the handle are located in the same plane. This means that once the filter grabbing part is applied to the oil filter, the torque that is applied by the handle must be in the same plane as the filter grabbing part. Often, however, the under hood area of a motor vehicle is a quite crowded space, and it is difficult to satisfactorily position the handle in the same plane of the filter grabbing part so that successful application of torque on the handle can take place. In this respect, it would be desirable if an oil filter wrench device were provided that included a handle that could be adjusted to be outside the plane of the filter grabbing part of the wrench. In this way, the wrench would have greater applicability and utility in crowded engine spaces.

Other features would also be desirable in an oil filter wrench. When an oil filter is installed on an engine, there is a specified range of torque at which the oil filter should be installed. Both overtightening and undertightening are to be avoided. In this respect, it would be desirable if an oil filter wrench device were provided that included an indicator that proper torque is applied during installation of the oil filter.

In the close confines of an engine compartment, when using an oil filter wrench, a user's hands may often be injured by either braises or burns. This is especially true of the knuckles of the hand that applies force to the handle of the oil filter wrench. In this respect, it would be desirable if an oil filter wrench device were provided that offered protection to the hand of the user that applies a force to the handle of the wrench.

Thus, while the foregoing body of prior art indicates it to be well known to use oil filter wrenches, the prior art described above does not teach or suggest a oil filter wrench which has the following combination of desirable features: (1) does not slip when oil is present on the surface of the oil filter; (2) does not require the user of the device to occupy two hands in manipulating the device; (3) can be successfully used with conventional oil filters and need not be used with special oil filters having bracket fin structures; (4) can be used for both removing and installing an oil filter; (5) does not puncture the oil filter housing and does not make an oily mess during oil filter removal; (6) does not deform or weaken the oil filter when the oil filter wrench is used;

(7) includes a handle that can be adjusted to be outside the plane of the filter grabbing part of the wrench; (8) includes an indicator that indicates when proper torque is applied during installation of the oil filter; and (9) offers protection to the hand of the user that applies a force to the handle of the wrench. The foregoing desired characteristics are provided by the unique oil filter wrench of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved oil filter wrench comprised of a band assembly which includes a first band end portion, a band mid-portion, and a second band end portion. The band assembly includes an inner band surface and an outer band surface. An abrasive-surface-containing flexible sheet assembly is connected to the band assembly and is installed over the inner band surface. A handle assembly is connected to the first band end portion and the second band end portion.

The abrasive-surface-containing flexible sheet assembly includes sandpaper strip. An adhesive layer is applied to a backside of the sandpaper strip, and a flexible, sandpaper strip mounting unit receives the adhesive-backed sandpaper strip. The flexible, sandpaper strip mounting unit includes connectors for connecting the flexible, sandpaper strip mounting unit to the band assembly.

The band assembly includes a plurality of mounting apertures, and the connectors include a plurality of mounting projections which project rearward from the flexible, sandpaper strip mounting unit and engage the mounting apertures, such that the flexible, sandpaper strip mounting unit, which includes the adhesive-backed sandpaper strip, is mounted on the band assembly.

The handle assembly includes a band tightening element which includes a first portion, a second portion, and a third portion. A first pivoting connection connects the first portion of the band tightening element to the first band end portion. A second pivoting connection connects the second portion of the band tightening element to the second band end portion. A handle member is connected to the third portion of the band tightening element.

A first pivoting connection pivots around a first longitudinal axis. A second pivoting connection pivots around a second longitudinal axis. The first longitudinal axis and the second longitudinal axis are parallel to each other.

The band assembly lies in a first plane. A third pivoting connection, which pivots around a third longitudinal axis, is perpendicular to the first longitudinal axis and the second longitudinal axis. The third pivoting connection connects the handle member to the third portion of the band tightening element, such that a portion of the handle member can be rotated around the third longitudinal axis and out of the first plane when the apparatus is used to install or remove an oil filter.

The band assembly includes two overlapping, sliding portions, a first sliding portion and a second sliding portion. The first sliding portion is connected to the second sliding portion by a slip joint.

A torque indicating assembly is connected to the band assembly for indicating torque applied by the apparatus to the oil filter. The torque indicating assembly includes an aperture-containing bent back portion of the first sliding portion, an alignment member, and a counterforce member. A portion of the alignment member passes through the aperture in the aperture-containing bent back portion. The counterforce member is connected to the second sliding portion, and a spring is located between the aperture-containing bent back portion and the counterforce member for urging the first sliding portion longitudinally away from the second sliding portion along the slip joint by a force exerted by the spring. The alignment member includes a portion that extends between the aperture-containing bent back portion and the counterforce member.

A hand-protecting shroud assembly is installed on the handle assembly for protecting a user's hand during use of the apparatus. The hand-protecting shroud assembly includes a semi-circular protective element. A C-shaped clamping unit is connected to the semi-circular protective element. The C-shaped clamping unit clamps against handle elements of the handle member for clamping the C-shaped clamping unit to the handle member. A nut and bolt assembly is used for securing the C-shaped clamping unit to the handle elements.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved oil filter wrench which has all of the advantages of the prior art and none of the disadvantages.

It is another object of the present invention to provide a new and improved oil filter wrench which may be easily and efficiently manufactured and marketed.

It is a further object of the present invention to provide a new and improved oil filter wrench which is of durable and reliable construction.

An even further object of the present invention is to provide a new and improved oil filter wrench which is susceptible of a low cost of manufacture with regard to both materials and labor, and which accordingly is then susceptible of low prices of sale to the consuming public, thereby making such oil filter wrench available to the buying public.

Still yet a further object of the present invention is to provide a new and improved oil filter wrench which does not slip when oil is present on the surface of the oil filter.

Still another object of the present invention is to provide a new and improved oil filter wrench that does not require the user of the device to occupy two hands in manipulating the device.

Yet another object of the present invention is to provide a new and improved oil filter wrench which can be successfully used with conventional oil filters and need not be used with special oil filters having bracket fin structures.

Even another object of the present invention is to provide a new and improved oil filter wrench that can be used for both removing and installing an oil filter.

Still a further object of the present invention is to provide a new and improved oil filter wrench which does not puncture the oil filter housing and does not make an oily mess during oil filter removal.

Yet another object of the present invention is to provide a new and improved oil filter wrench that does not deform or weaken the oil filter when the oil filter wrench is used.

Still another object of the present invention is to provide a new and improved oil filter wrench which includes a handle that can be adjusted to be outside the plane of the filter grabbing part of the wrench.

Yet another object of the present invention is to provide a new and improved oil filter wrench that includes an indicator that indicates when proper torque is applied during installation of the oil filter.

Still a further object of the present invention is to provide a new and improved oil filter wrench that offers protection to the hand of the user that applies a force to the handle of the wrench.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof, Such description makes reference to the annexed drawing wherein:

FIG. 3 is an enlarged partial cross-sectional view of the loop portion of the oil filter wrench of FIG. 1 taken along line 3—3 thereof, FIG. 4 is an exploded perspective view of an adhesive-backed abrasive strip assembly used with the embodiment of the invention shown in FIG. 1.

DESCRIPTION OF THE PREFERRED EMBODIMENT

Figure 1:
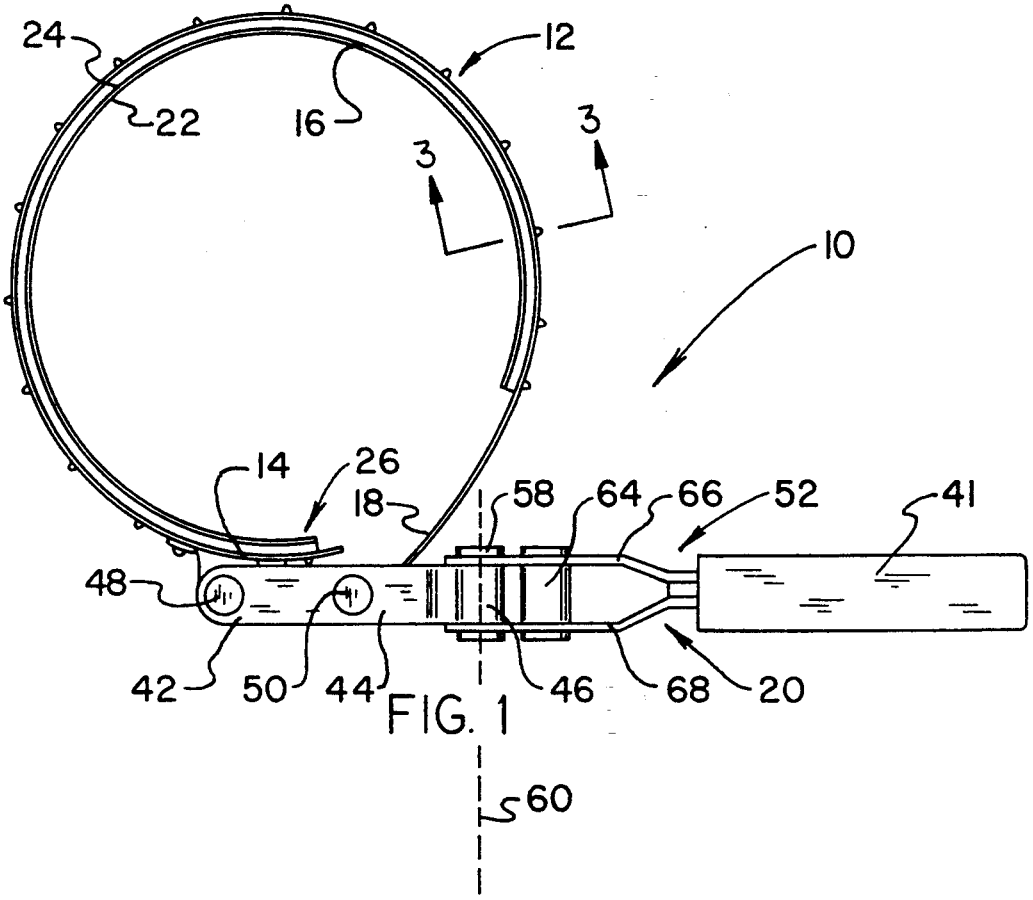
FIG. 1 is a top view showing a first preferred embodiment of the oil filter wrench of the invention.

With reference to the drawings, a new and improved oil filter wrench embodying the principles and concepts of the present invention will be described.

Turning initially to FIGS. 1–4, there is shown a first exemplary embodiment of the oil filter wrench of the invention generally designated by reference numeral 10. In its preferred form, oil filter wrench 10 includes a band assembly 12 which includes a first band end portion 14, a band mid-portion 16, and a second band end portion 18. The band assembly 12 includes an inner band surface 22 and an outer band surface 24. An abrasive-surface-containing flexible sheet assembly 26 is connected to the band assembly 12 and is installed over the inner band surface 22. A handle assembly 20 is connected to the first band end portion 14 and the second band end portion 18. The abrasive-surface-containing flexible sheet assembly 26 provides a substantial amount of friction and prevents slippage of the oil filter wrench 10 of the invention even on an oil filter that has an oily outer surface. The abrasive-surface-containing flexible sheet assembly 26 includes a sandpaper strip 28. The sandpaper strip 28 includes an adhesive layer 30 applied to a backside of the sandpaper strip 28.

As shown in FIGS. 3 and 4, the abrasive-surface-containing flexible sheet assembly 26 includes sandpaper strip 28. An adhesive layer 30 is applied to a backside of the sandpaper strip 28, and a flexible, sandpaper strip mounting unit 34 receives the adhesive-backed sandpaper strip 28. The flexible, sandpaper strip mounting unit 34 includes connectors 36 for connecting the flexible, sandpaper strip mounting unit 34 to the band assembly 12. The connectors 36 can be made as slightly separated push snaps.

The band assembly 12 includes a plurality of mounting apertures 38, and the connectors 36 include a plurality of mounting projections 36 which project rearward from the flexible, sandpaper strip mounting unit 34 and engage the mounting apertures 38, such that the flexible, sandpaper strip mounting unit 34, which includes the adhesive-backed sandpaper strip 28, is mounted on the band assembly 12.

The handle assembly 20 includes a band tightening element 40 which includes a first portion 42, a second portion 44, and a third portion 46. A first pivoting connection 48 connects the first portion 42 of the band tightening element 40 to the first band end portion 14. A second pivoting connection 50 connects the second portion 44 of the band tightening element 40 to the second band end portion 18. A handle member 52 is connected to the third portion 46 of the band tightening element 40. A hand grip portion 41 is provided on the handle member 52.

The first pivoting connection 48 pivots around a first longitudinal axis 54. The second pivoting connection 50 pivots around a second longitudinal axis 56. The first longitudinal axis 54 and the second longitudinal axis 56 are parallel to each other.

The band assembly 12 lies in a first plane 62. A third pivoting connection 58, which pivots around a third longitudinal axis 60, is perpendicular to the first longitudinal axis 54 and the second longitudinal axis 56. The third pivoting connection 58 connects the handle member 52 to the third portion 46 of the band tightening element 40, such that a portion of the handle member 52 can be rotated around the third longitudinal axis 60 and out of the first plane 62 when the apparatus is used to install or remove an oil filter.

Figure 2:
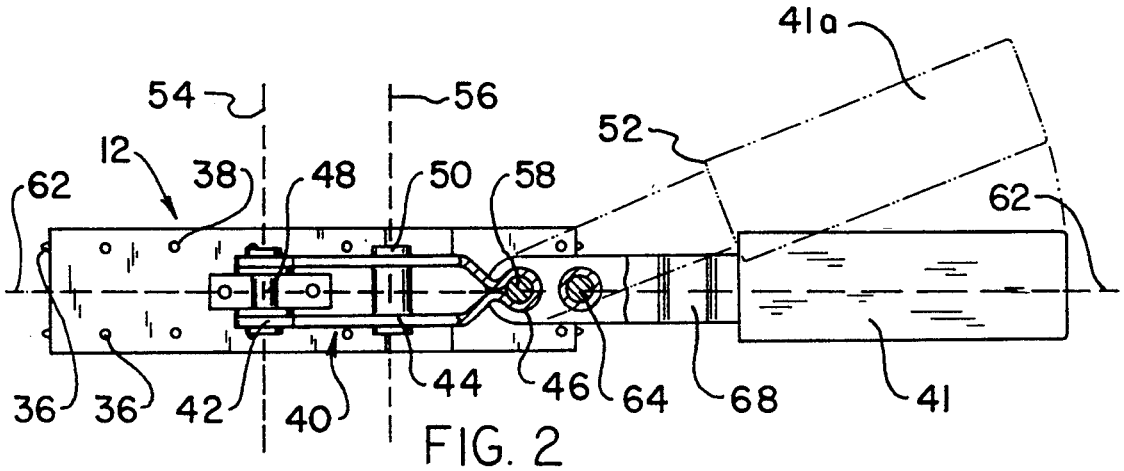
FIG. 2 is a side view of the oil filter wrench of FIG. 1 showing a swivel handle in two different positions.

The hand grip portion 41a in FIG. 2 is shown above the first plane 62 after having been rotated around the third longitudinal axis 60 and the third pivoting connection 58. In addition, a rigid support member 64 spans two handle elements 66 and 68 to provide support to the handle member 52.

Figure 5:
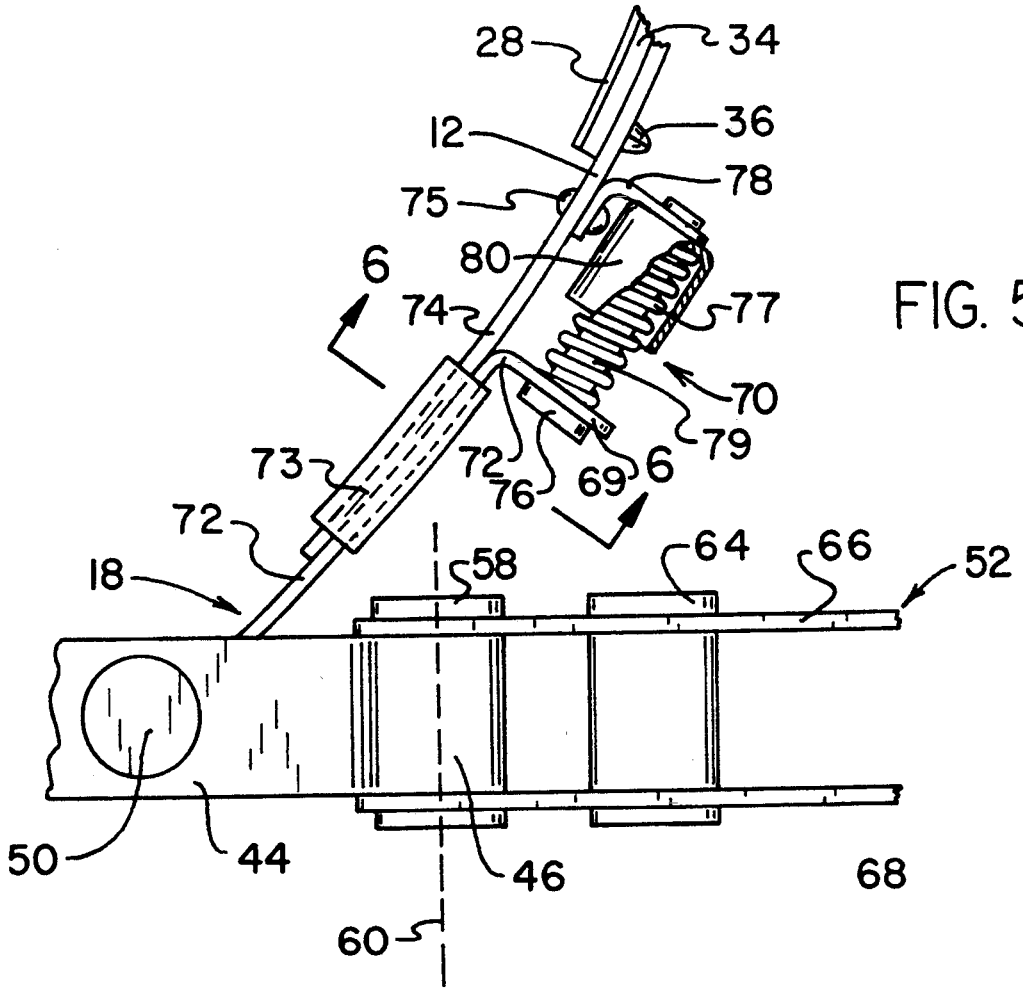
FIG. 5 a partial top view of a second preferred embodiment of the invention of the oil filter wrench showing a torque indicating assembly.
Figure 6:
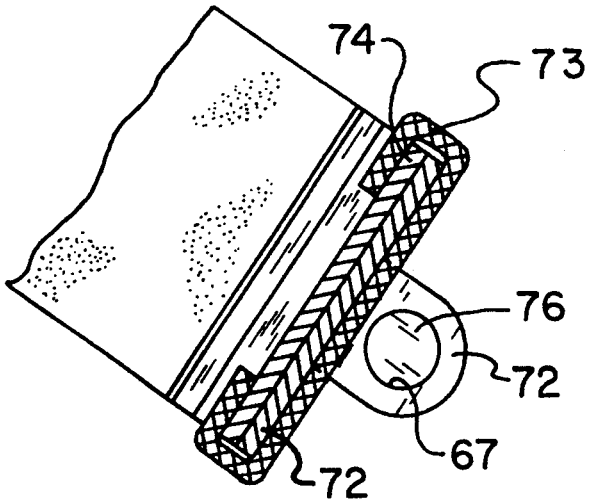
FIG. 6 is a partial cross-sectional view of the torque indicating assembly shown in FIG. 5 taken along line 6—6 of FIG. 5.

Turning to FIGS. 5–6, a second embodiment of the invention is shown. Reference numerals are shown that correspond to like reference numerals that designate like elements shown in the other figures. In addition, torque indicating assembly 70 is connected to the band assembly 12, for indicating torque applied by the apparatus to the oil filter.

The band assembly 12 includes two overlapping, sliding portions, a first sliding portion 72 and a second sliding portion 74. The first sliding portion 72 is connected to the second sliding portion 74 by a slip joint secured by a sleeve 73.

The torque indicating assembly 70 includes an aperture-containing bent back portion 69 of the first sliding portion 72, an alignment member 76, and a counterforce member 78. A portion of the alignment member 76 passes through the aperture 67 in the aperture-containing bent back portion 69. The counterforce member 78 is connected to the second sliding portion 74 by a rivet 75, and a spring 77 is located between the aperture-containing bent-back portion 69 and the counterforce member 78 for urging the first sliding portion 72 longitudinally away from the second sliding portion 74 along the slip joint by a force exerted by the spring 77. The alignment member 76 includes a portion 79 that extends between the aperture-containing bent back portion 69 and the counterforce member 78.

In operation, to tighten an oil filter onto an engine, the band assembly 12 is first placed over the oil filter. The handle assembly 20 is turned in a direction so that the effective circumference of the band assembly 12 decreases. If desired, the hand grip portion 41 is moved up or down around third pivoting connection 58 and third longitudinal axis 60 to facilitate turning of the oil filter in tight quarters. As the band assembly 12 is tightened, the torque on the band assembly 12 increases. As the band assembly 12 continues to be tightened, the torque continues to be applied. If the torque increases sufficiently, the magnitude of the counterforce exerted by the spring 77 is reached. As the torque increases above the counterforce exerted by the spring 77, the spring begins to compress. Compression of the spring 77 is clearly visible as the longitudinal distance between the aperture-containing bent back portion 69 and the counterforce member 78 decreases. When that distance decreases, the predetermined torque, as determined by the force constant of the spring 77 has been reached. Thus, reaching the desired torque is observed by a decrease in the distance between the aperture-containing bent back portion 69 and the counterforce member 78.

Alternatively, the oil filter wrench 10 of the invention may be used to remove an oil filter from an engine. To use the apparatus in this way, the band assembly 12 is placed over the oil filter in an orientation that is upside down to the orientation for tightening the oil filter. In this way, the handle assembly 20 is oriented in an opposite direction for installing the oil filter. The handle assembly 20 is turned in a direction so that the effective circumference of the band assembly 12 decreases. If desired, the hand grip portion 41 is moved up or down around third pivoting connection 58 and third longitudinal axis 60 to facilitate turning of the oil filter in tight quarters. As the band assembly 12 is tightened, the torque on the band assembly 12 increases. As the band assembly 12 continues to be tightened, the torque continues to be applied. If the torque increases sufficiently, the magnitude of the counterforce exerted by the spring 77 is reached. As the torque increases above the counterforce exerted by the spring 77, the spring begins to compress. If further torque is applied, the aperture-containing bent back portion 69 moves sufficiently toward the counterforce member 78 so that the aperture-containing bent back portion 69 reaches an edge of stop member 80 which is positioned at a predetermined location between the aperture-containing bent back portion 69 and the counterforce member 78. Once the stop member 80 is reached. A torque can be applied to the oil filter that exceeds the counter torque exerted by the force constant of the spring 77.

Figure 7:
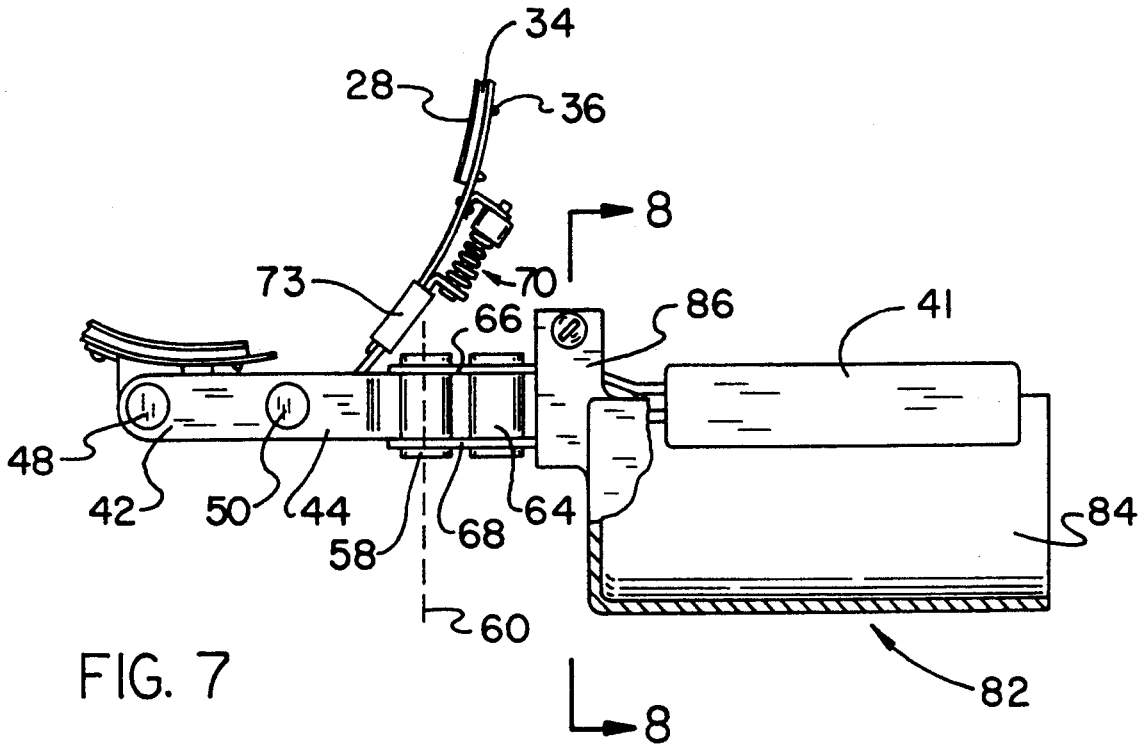
FIG. 7 is a partial top view, in partial cross-section showing a third embodiment of the oil filter wrench of the invention which includes an assembly for guarding the hand of the user.
Figure 8:
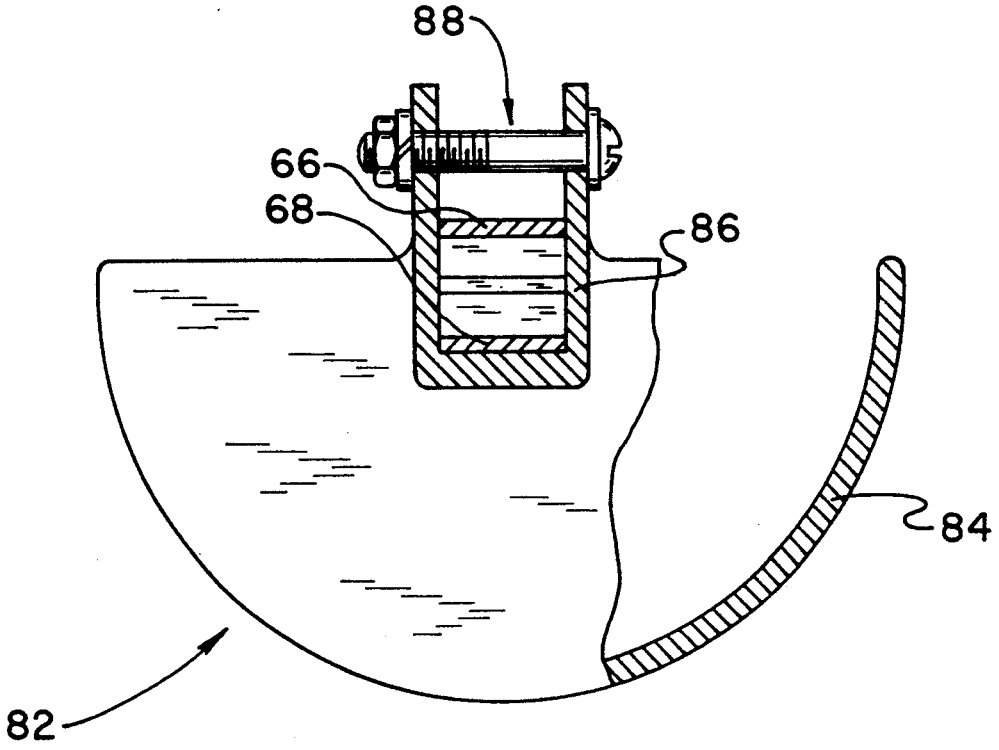
FIG. 8 is an enlarged cross-sectional view of the hand guard assembly shown in FIG. 7 taken along the line 8—8 thereof.

Turning to FIGS. 7–8, a third embodiment of the invention is shown. Reference numerals are shown that correspond to like reference numerals that designate like elements shown in the other figures. In addition, a hand-protecting shroud assembly 82 is installed on the handle assembly 20 for protecting a user's hand during use of the apparatus.

The hand-protecting shroud assembly 82 includes a semi-circular protective element 84. A C-shaped clamping unit 86 is connected to the semi-circular protective element 84. The C-shaped damping unit 86 damps against handle elements 66 and 68 of the handle member 52 for clamping the C-shaped clamping unit 86 to the handle member 52. A nut and bolt assembly 88 is used for securing the C-shaped clamping unit 86 to the handle elements 66 and 68.

In using the hand-protecting shroud assembly 82, a user simply grasps the hand grip portion 41 of the handle member 52, and the semi-circular protective element 84 protects the user's hand from hot spots on the engine and from abrasions.

The components of the oil filter wrench of the invention can be made from inexpensive and durable metal, plastic, and abrasive materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved oil filter wrench that is low in cost, relatively simple in design and operation, and which may advantageously be used so as not to slip when oil is present on the surface of the oil filter. With the invention, an oil filter wrench is provided which does not require the user of the device to occupy two hands in manipulating the device. With the invention, an oil filter wrench is provided which can be successfully used with conventional oil filters and need not be used with special oil filters having bracket fin structures. With the invention, an oil filter wrench is provided which can be used for both removing and installing an oil filter. With the invention, an oil filter wrench is provided which does not puncture the oil filter housing and does not make an oily mess during oil filter removal. With the invention, an oil filter wrench is provided which does not deform or weaken the oil filter when the off filter wrench is used. With the invention, an oil filter wrench is provided which includes a handle that can be adjusted to be outside the plane of the filter grabbing part of the wrench. With the invention, an oil filter wrench is provided which includes an indicator that indicates when proper torque is applied during installation of the oil filter. With the invention, an oil filter wrench is provided which offers protection to the hand of the user that applies a force to the handle of the wrench.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A new and improved oil filter wrench apparatus, comprising:

a band assembly which includes a first band end portion, a band mid-portion, and a second band end portion, said band assembly including an inner band surface and an outer band surface, an abrasive-surface-containing flexible sheet assembly connected to said band assembly and installed over said inner band surface, wherein said abrasive-surface-containing flexible sheet assembly includes an abrasive-surface-containing flexible sheet and a mounting unit which receives said abrasive-surface-containing flexible sheet and which includes connector means for connecting said abrasive-surface-containing flexible sheet assembly to said band assembly, wherein said band assembly includes a plurality of mounting apertures, and said connector means include a plurality of mounting projections which project rearward from said mounting unit and engage said mounting apertures, such that said mounting unit, which supports said abrasive-surface-containing flexible sheet, is mounted on said band assembly, and a single handle assembly connected to said first band end portion and said second band end portion.

2. The apparatus described in claim 1 wherein said abrasive-surface-containing flexible sheet assembly includes a sandpaper strip.

3. The apparatus described in claim 2 wherein said sandpaper strip includes an adhesive layer applied to a backside of said sandpaper strip.

4. The apparatus described in claim 1 wherein said abrasive-surface-containing flexible sheet assembly includes:

an abrasive-surface-containing flexible sheet comprised of a sandpaper strip, an adhesive layer applied to a backside of said sandpaper strip, and a flexible, sandpaper strip mounting unit which receives said adhesive-backed sandpaper strip and which includes connector means for connecting said flexible, sandpaper strip mounting unit to said band assembly.

5. A new and improved oil filter wrench apparatus, comprising:

a band assembly which includes a first band end portion, a band mid-portion, and a second band end portion, said band assembly including an inner band surface and an outer band surface, wherein said band assembly lies in a first plane, an abrasive-surface-containing flexible sheet assembly connected to said band assembly and installed over said inner band surface, wherein said abrasive-surface-containing flexible sheet assembly includes an abrasive-surface-containing flexible sheet and a mounting unit which receives said abrasive-surface-containing flexible sheet and which includes connector means for connecting said abrasive-surface-containing flexible sheet assembly to said band assembly, wherein said band assembly includes a plurality of mounting apertures, and said connector means include a plurality of mounting projections which project rearward from said mounting unit and engage said mounting apertures, such that said mounting unit, which supports said abrasive-surface-containing flexible sheet, is mounted on said band assembly, and a handle assembly connected to said first band end portion and said second band end portion, wherein said handle assembly includes:

a band tightening element including a first portion, a second portion, and a third portion, a first pivoting connection connecting said first portion of said band tightening element to said first band end portion, wherein said first pivoting connection pivots around a first longitudinal axis, a second pivoting connection connecting said second portion of said band tightening element to said second band end portion, wherein said second pivoting connection pivots around a second longitudinal axis, and wherein said first longitudinal axis and said second longitudinal axis are parallel to each other, and a handle member connected to said third portion of said band tightening element, a third pivoting connection which pivots around a third longitudinal axis which is perpendicular to said first longitudinal axis and said second longitudinal axis, said third pivoting connection connecting said handle member to said third portion of said band tightening element, such that a portion of said handle member can be rotated around said third longitudinal axis and out of said first plane when said apparatus is used to install or remove an oil filter.

* * * * *